US007113711B2

(12) United States Patent
Okamura

(10) Patent No.: US 7,113,711 B2
(45) Date of Patent: Sep. 26, 2006

(54) DEVICE AND METHOD OF MANAGING LIFE OF TONER CARTRIDGE, AND IMAGE FORMING APPARATUS USING THE SAME

(75) Inventor: Takehiko Okamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 204 days.

(21) Appl. No.: 10/851,475

(22) Filed: May 21, 2004

(65) Prior Publication Data

US 2005/0008378 A1 Jan. 13, 2005

(30) Foreign Application Priority Data

May 23, 2003 (JP) ..... P2003-146039

(51) Int. Cl.
*G03G 15/00* (2006.01)
*G03G 15/08* (2006.01)

(52) U.S. Cl. ..... 399/27; 399/81

(58) Field of Classification Search ..... 399/27, 399/28, 29, 24, 25, 81
See application file for complete search history.

(56) References Cited

U.S. PATENT DOCUMENTS

2001/0026692 A1* 10/2001 Miura et al. ..... 399/27
2004/0105689 A1* 6/2004 Shimura et al. ..... 399/27 X
2004/0114946 A1* 6/2004 Koyama et al. ..... 399/27

FOREIGN PATENT DOCUMENTS

JP 2000-035713 A * 2/2000
JP 2005-083846 3/2002
JP 2002-174929 6/2002

* cited by examiner

*Primary Examiner*—Sophia S. Chen
(74) *Attorney, Agent, or Firm*—Hogan & Hartson LLP

(57) ABSTRACT

It is managed a life of at least one toner cartridge loaded in an apparatus for forming an image on a recording medium with toner stored in the toner cartridge. A counter counts a remaining amount of each of a plurality of predetermined parameters. A replacement determinant determines that the toner cartridge should be replaced with another one when the remaining amount of any one of the parameters is a predetermined amount or less. A display is operable to display the remaining amount of each of the parameters as a percentage relative to a full remaining amount thereof. A selector selects one of the parameters indicating the lowest remaining amount as the remaining amount displayed on the display.

16 Claims, 9 Drawing Sheets

| TYPE | COLOR | COUNT VALUE |
|---|---|---|
| Pa | Y | a1 |
| | C | a1 |
| | M | a1 |
| | K | a2 |
| Pb | Y | a3 |
| | C | a3 |
| | M | a3 |

DEVICE AND METHOD OF MANAGING LIFE OF TONER CARTRIDGE, AND IMAGE FORMING APPARATUS USING THE SAME

BACKGROUND OF THE INVENTION

The present invention relates to a device and method of managing the life of a toner cartridge as well as an image-forming apparatus using the same.

An image forming apparatus which forms an image through use of toner must manage the life of a toner cartridge by ascertaining the amount of toner consumption or the amount of remaining toner in order to facilitate maintenance, such as toner replenishment, or preservation of image quality. Japanese Patent Publication No. 2002-174929A discloses a method for calculating toner consumption with simple configuration which enable accurate determination of toner consumption.

A relationship between the number of a printed dot and the amount of toner consumption is nonlinear, and the relationship also changes depending on the state of another printed dot adjacent to that printed dot. In light of this relationship, the method classifies a train of printed dots into three patterns; that is, an isolated dot, two consecutive dots, and an dot of intermediate value. The number of dots formed is counted on a per-pattern basis. The amount of toner consumption is determined on the basis of the counted values.

In such an image forming apparatus, the toner filled in the toner cartridge is gradually consumed and decreased as a result of repeated formation of an image. When the amount of toner filled in the cartridge has decreased to a certain level or less, a message "Please replace the toner cartridge" appears on a display of the image forming apparatus, thereby alerting the user.

Even in view of effective utilization of resources, the user desires to accurately recognize the amount of toner consumption and replace a toner cartridge at an appropriate time. This publication teaches a pattern into which a train of printed dots is arranged is classified into three categories. There is disclosed determination of the amount of toner consumed per page during a certain job period on the basis of the pattern in which a train of printed dots is arranged. However, there is no description on the configuration for knowing the residual amount of toner contained in the toner cartridge and judging the point of time for the interchange of the toner cartridge.

Japanese Patent Publication No. 2001-83846A discloses a technique for individually displaying the residual amounts of toner for a large-capacity cartridge and a small-capacity cartridge. Specifically, there are provided a gauge used for displaying the residual amount of toner corresponding to the large-capacity cartridge and a gauge used for displaying the residual amount of toner corresponding to the small-capacity cartridge. In this case, the residual amounts of toner are displayed as absolute values (analog values). For this reason, the user can judge the current values of the residual amounts of toner visually.

However, there is a problem that the cost of the mechanism for individually displaying the residual amounts of toner increases. Moreover, the residual amount of toner in the small-capacity cartridge is displayed at a reduced ratio compared with the residual amount of toner in the large-capacity cartridge or displayed with a color different from the color used for displaying the residual amount of toner in the large-capacity cartridge. Or the two display forms are different, for example, in the width of change of each gauge.

There is a problem that the user has a difficulty in reading the displayed residual amounts of toner.

SUMMARY OF THE INVENTION

It is therefore an object of the invention to provide a device and method for managing the life of a toner cartridge in which the residual amount of a count value easy for a user to view can be displayed inexpensively. It is also an object of the invention to provide an image forming apparatus using such device and method.

In order to achieve the above objects, according to the invention, there is provided a device for managing a life of at least one toner cartridge loaded in an apparatus for forming an image on a recording medium with toner stored in the toner cartridge, the device comprising:

a counter, which counts a remaining amount of each of a plurality of predetermined parameters;

a replacement determinant, which determines that the toner cartridge should be replaced with another one when the remaining amount of any one of the parameters is a predetermined amount or less;

a display, operable to display the remaining amount of each of the parameters as a percentage relative to a full remaining amount thereof; and a selector, which selects one of the parameters indicating the lowest remaining amount as the remaining amount displayed on the display.

With such a configuration, a user can certainly recognize a time that the toner cartridge should be replaced with another one.

Preferably, the toner cartridge is provided with a development roller which supplies the toner to the outside of the toner cartridge. The parameters includes an amount of the toner remaining in the toner cartridge, and a remained operable time of the development roller.

Here, it is preferable that a plurality of toner cartridges having different capacities are provided for the same color. The display is provided with a scale which is common to the parameters and the toner cartridges, so that a predetermined percentage is associated with a threshold value regarding the remaining amount for each of the parameters and the toner cartridges.

With such a configuration, the display can be inexpensively provided. Further, the user can recognize the remaining amount of the toner irrespective of the size of the toner cartridges without confusion.

The threshold value may be the same as or different from the predetermined value. In accordance with the preset configuration, the replacement time of the toner cartridge can be ascertained as the user requires.

It is also preferable that the device further comprises a storage, which stores an initial amount of the toner remaining in the toner cartridge as the full remaining amount. The counter subtracts a consumed amount of the toner to determine the amount of toner remaining in the toner cartridge.

It is also preferable that the device further comprises a storage, which stores an initial amount of the operable time of the development roller as the full remaining amount. The counter subtracts an operated time of the development roller to determine the remained operable time of the development roller.

For both cases, it is further preferable that the storage is provided with the toner cartridge. With such a configuration, the life management can be secured even if the toner cartridge is temporarily unloaded from the image forming apparatus.

It is also preferable that a plurality of colors of toner including black toner are used to form the image. The threshold value associated with the black toner is less than the threshold value associated with any one of the colors of toner. In general, the black toner is consumed more than any other colors of toner. Therefore, the opportunity for replacing the cartridge for the black toner can be decreased.

It is also preferable that the remaining amount for one of the toner cartridges which is associated with the predetermined amount is different from the remaining amount for another one of the toner cartridges which is associated with the predetermined amount.

Preferably, the predetermined amount is changed in accordance with an image occupation ratio which is an area ratio of the image formed with the toner relative to the recording medium.

According to the invention, there is also provided a method for managing a life of at least one toner cartridge loaded in an apparatus for forming an image on a recording medium with toner stored in the toner cartridge, the method comprising steps of:

counting a remaining amount of each of a plurality of predetermined parameters;

determining that the toner cartridge should be replaced with another one when the remaining amount of any one of the parameters is a predetermined amount or less;

selecting one of the parameters indicating the lowest remaining amount; and displaying the lowest remaining amount of the selected one of the parameters on a display as a percentage relative to a full remaining amount thereof.

With such a configuration, the internal processing performed in the display can be simplified.

According to the invention, there is also provided an image forming apparatus, comprising the above device, wherein the toner supplied from the toner cartridge is transferred onto an image supporting member to form a toner image for visualizing an electrostatic latent image formed on the image supporting member in advance.

Preferably, the toner image is transferred onto an intermediate transferring member before the toner image is transferred onto the recording medium.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 8:
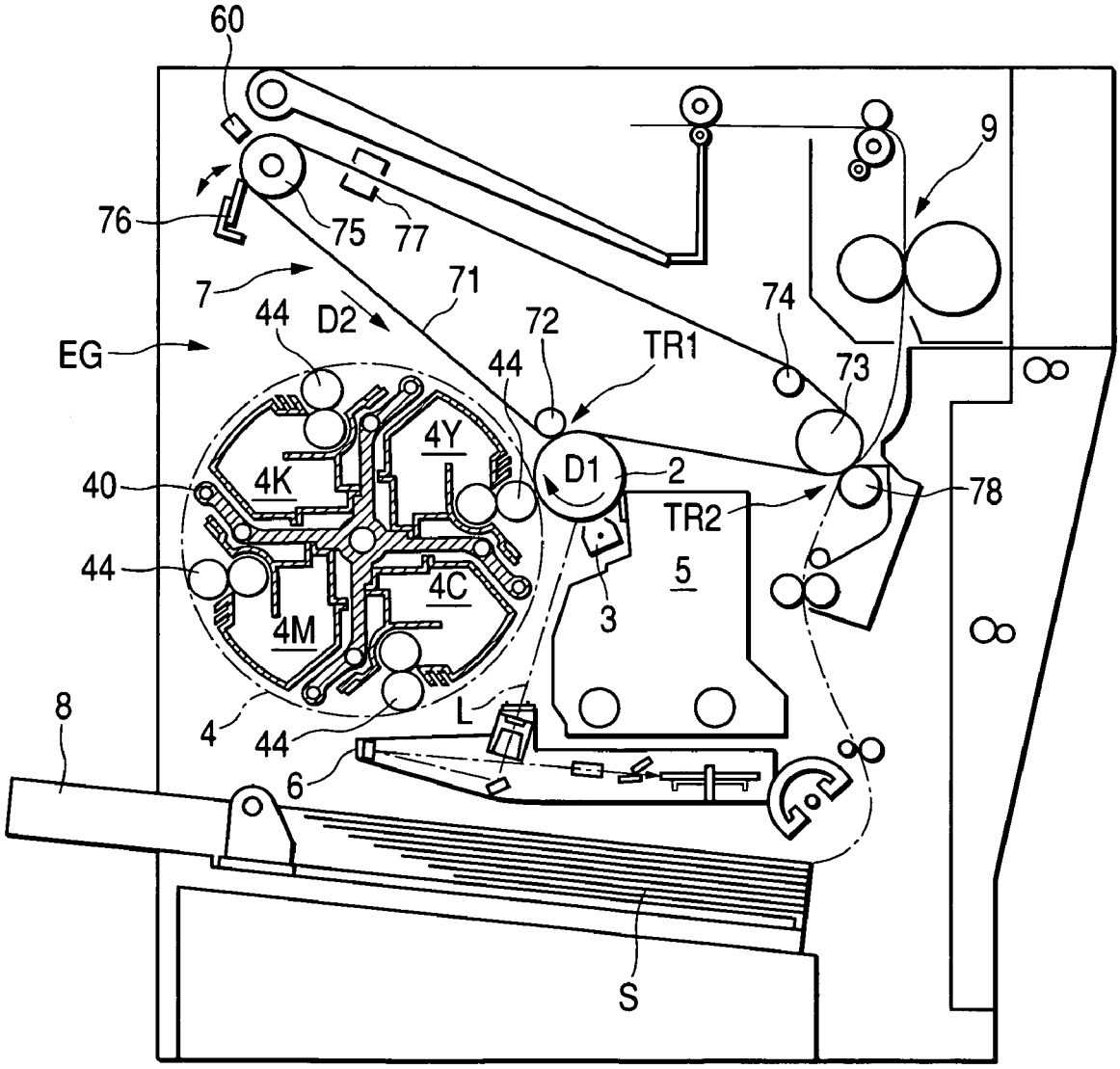
FIG. 8 is a section view showing an image forming apparatus.

Preferred embodiments of the present invention will be described hereinbelow in detail with reference to the accompanying drawings. An image forming apparatus shown in FIG. 8 is for forming a full-color image by superposing four-color images; that is, a yellow (Y) toner image, a cyan (C) toner image, a magenta (M) toner image, and a black (K) toner image, and a monochrome image through use of only the black (K) toner image. In the image forming apparatus of the present invention, an image signal is inputted to a main controller 11 from an external apparatus such as a host computer in accordance with a user's request for forming an image. At this time, an instruction signal is transmitted from the main controller 11 to an engine controller 10. In accordance with the instruction signal, the engine controller 10 controls individual sections of an engine section EG, thereby forming on a sheet S (recording medium) an image corresponding to the image signal.

Figure 7:
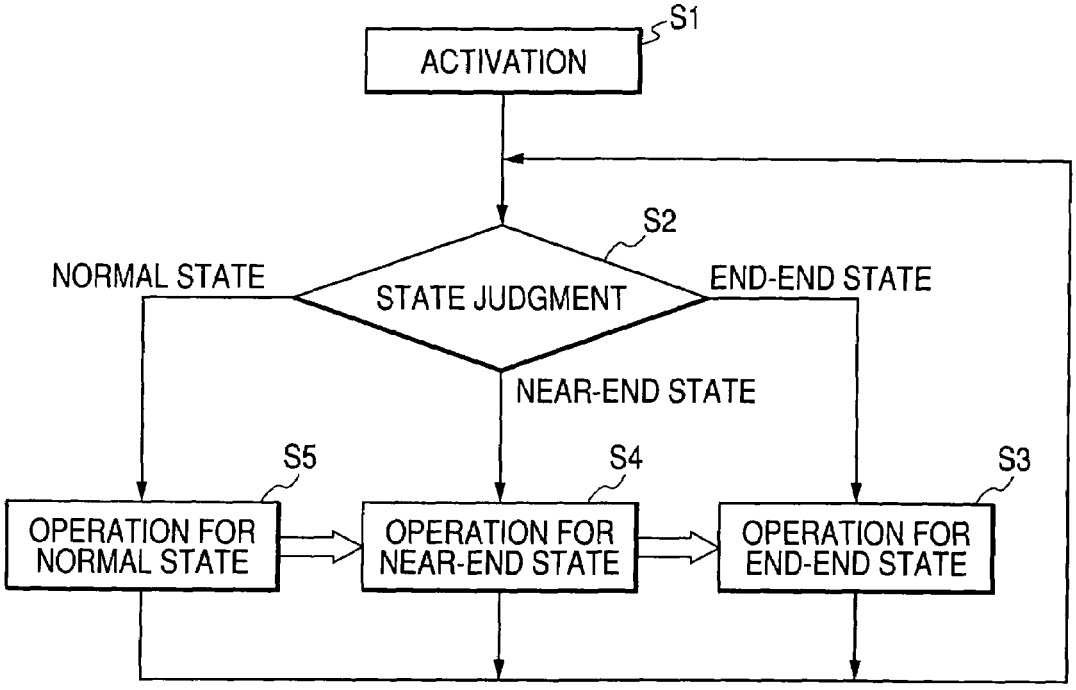
FIG. 7 is a flow chart showing a process of judging the life of the toner cartridge.

This engine section EG is provided with a photosensitive member 2 serving as an image carrier, such that the photosensitive member is rotatable in the direction of an arrow D1 shown in FIG. 7. A charger 3, a rotary developer 4, and a cleaner 5 are provided around the photosensitive member 2 along the rotating direction D1 thereof. A charging bias output from a charging controller 103 is applied to the charger 3, thereby uniformly charging an outer peripheral surface of the photosensitive member 2 to a predetermined surface potential. A light beam L is emitted from an exposer 6 toward the outer peripheral surface of the photosensitive member 2 charged by the charger 3. In accordance with a control instruction issued by an exposure controller 102, the exposer 6 irradiates the photosensitive member 2 with the light beam L, thereby forming an electrostatic latent image corresponding to an image signal. The exposer 6 is provided with optical elements, such as a lens, a mirror, or the like, as required.

When an image signal is delivered from an external apparatus, such as a host computer, to a CPU 111 of the main controller 11 by way of an interlace 112, a CPU 101 of the engine controller 10 outputs, to the exposure controller 102 and at a predetermined timing, a control signal corresponding to the image signal. The light beam L is radiated from the exposer 6 on the photosensitive member 2 in accordance with this control signal, whereupon an electrostatic latent image corresponding to the image signal is formed on the photosensitive member 2.

The thus-formed electrostatic latent image is subjected to toner development by the rotary developer 4. Specifically, in the present embodiment, the rotary developer 4 is equipped with a support frame 40 which is provided so as to be rotatable about the axial center; and another member, such as a rotary driver omitted from the drawing.

The rotary developer 4 is further provided with an yellow developing section 4Y, a cyan developing section 4C, a magenta developing section 4M, and a black developing section 4K, which are detachably installed in the support frame 40 and accommodate colors of toner (the color developing sections 4Y, 4C, 4M, and 4K are herein sometimes called "toner cartridges").

Figure 9:
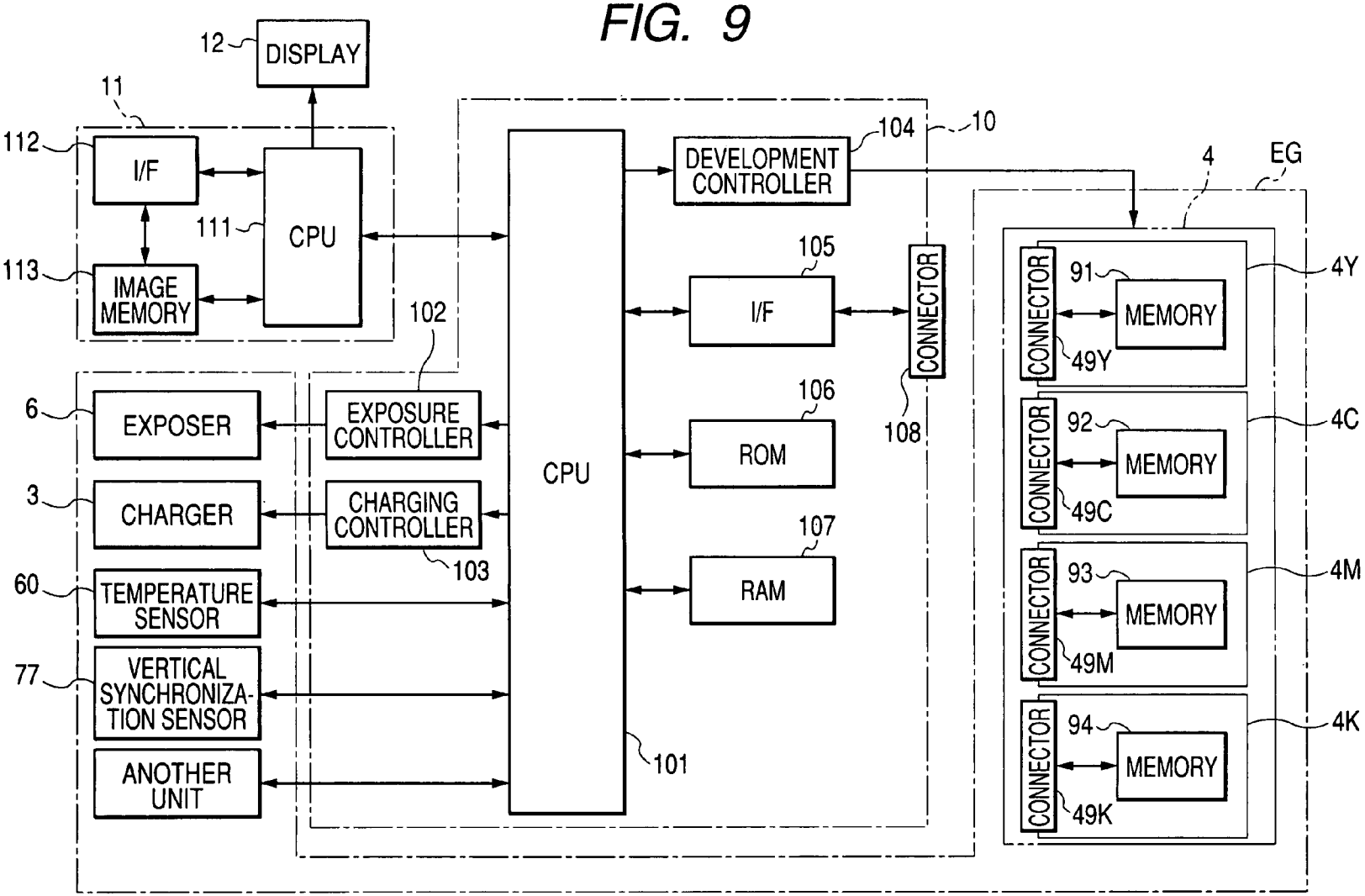
FIG. 9 is a block diagram showing an electrical configuration of the image forming apparatus of FIG. 8.

As shown in FIG. 9, the rotary developer 4 is controlled by a development controller 104. In accordance with a control instruction output from the development controller 104, the rotary developer 4 is rotated. The developing sections 4Y, 4C, 4M, and 4K are selectively placed at predetermined development positions opposing to the photosensitive member 2, thereby imparting a selected color of toner to the surface of the photosensitive member 2. As a result, the electrostatic latent image on the photosensitive member 2 is rendered visible in the selected color of toner.

A development roller 44 provided on the developing section is placed at the development position (i.e., the yellow developing section 4Y in the embodiment shown in FIG. 8) and comes into contact with the photosensitive member 2 or is arranged so as to oppose the photosensitive member 2 with a predetermined gap therebetween. The development roller 44 serves as a toner carrier for carrying the frictionally-charged toner to the surface of the photosensitive member 2. As the development roller 44 rotates, the toner is sequentially transported to the position where the development roller 44 opposes the photosensitive member 2 having an electrostatic latent image formed thereon.

Here, the developing section controller 104 applies, to the development roller 44, a development bias on which a DC voltage and an AC voltage are superposed. By such a development bias, the toner carried by the development roller 44 partially adheres to individual sections of the surface of the photosensitive member 2 in accordance with the surface potentials of the sections, whereby the electrostatic latent image formed on the photosensitive member 2 is rendered visible as a toner image of the toner color.

The toner image developed by the developer 4 in the manner mentioned above is transferred to an intermediate transfer belt (an intermediate transfer member) 71 of a transferor 7 in a primary transfer area TR1 through primary transfer. The transferor 7 comprises the intermediate transfer belt 71 suspended by a plurality of rollers 72 to 75; and a drive section (not shown) for circulating the intermediate transfer belt 71 in a predetermined rotating direction D2 by rotating the roller 73.

Moreover, a secondary transfer roller 78, which is retractably brought into contact with the surface of the belt 71 by an unillustrated electromagnetic clutch, is disposed at a position which opposes the roller 73 with the intermediate transfer belt 71 interposed therebetween. When a color image is transferred to a sheet S (recording medium), the toner images of respective colors formed on the photosensitive member 2 are superposed on the intermediate transfer belt 71, to thereby form a color image.

A color image is transferred onto the sheet S which is taken out of a cassette 8 and conveyed to a secondary transfer area TR2 between the intermediate transfer belt 71 and a secondary transfer roller 78. Moreover, the sheet having the color image formed thereon is transported to an output tray section provided on a top section of a main body of the apparatus by way of a fixer 9.

The surface potential of the photosensitive member 2 that has transferred the toner image on the intermediate transfer belt 71 through primary transfer operation is reset by a discharger omitted from the drawing. After the toner remaining on the surface of the photosensitive member 2 has been removed by the cleaner 5, the photosensitive member 2 is subjected to the next charging by the charger 3. The toner removed by the cleaner 5 is recovered by an unillustrated toner tank.

A cleaner 76, a density sensor 60, and a vertical synchronization sensor 77 are arranged in the vicinity of the roller 75. Of these elements, the cleaner 76 can be retractably brought into close contact with the roller 75 by an unillustrated electromagnetic clutch. A blade of the cleaner 76 comes into contact with the surface of the intermediate transfer belt 71 passed around the roller 75 with the cleaner 76 having moved to the roller 75, thereby removing the toner still remaining on and adhering to the outer peripheral surface of the intermediate transfer belt 71 after secondary transfer operation. The toner removed by the blade of the cleaner 76 is recovered by a waste toner tank (not shown).

The vertical synchronization sensor 77 is a sensor for detecting the reference position of the intermediate transfer belt 71. The vertical synchronization sensor 77 is a sensor for acquiring a synchronization signal output in association with circulation of the intermediate transfer belt 71; that is, a vertical synchronization signal Vsync. In this apparatus, operations of the individual sections of the apparatus are controlled in accordance with the vertical synchronization signal Vsync in order to make operation timings of the individual sections coincide with each other and accurately superpose the toner images formed in respective colors on each other. The density sensor 60 is disposed so as to oppose to the surface of the intermediate transfer belt 71. In the density control operation, the optical density of the patch image formed on the outer peripheral surface of the intermediate transfer belt 71 is measured.

As shown in FIG. 9, the respective developing sections (toner cartridges) 4Y, 4C, 4M, and 4K are equipped with memory devices 91 to 94 for storing data pertaining to a manufacturing lot of the developing sections, the history of use of the developing sections, and the amount of toner remaining in the developing sections. The respective developing sections 4Y, 4C, 4M, and 4K are provided with connectors 49Y, 49C, 49M, and 49K.

The connectors 49Y, 49C, 49M, and 49K are selectively connected to a connector 108 provided on the main body, as required. Therefore, data are exchanged between the CPU 101 of the engine controller 10 and the memory devices 91 to 94 by way of an interface 105, thereby managing various information items such as consumable item management of the developing sections (i.e., the cartridges). In this embodiment, the connector 108 of the main body and the connector 49K of the developing section are mechanically fitted together, thereby mutually exchanging data. However, data may be exchanged in a non-contact manner through use of, e.g., electromagnetic means such as radio communication.

The memory devices 91 to 94 for storing data unique to the respective developing sections 4Y, 4C, 4M, and 4K are preferably nonvolatile memory devices capable of storing data even while the memory devices remain in a powered off state or even while the developing sections are removed from the main body. For instance, a flash memory, a ferroelectric memory (FRAM, Ferroelectric Random Access Memory), or an EEPROM (Electronically Erasable and Programmable Read Only Memory) can be used as such nonvolatile memory.

Although omitted from FIG. 8, the image forming apparatus is provided with a display 12 (FIG. 9). A predetermined message is displayed in accordance with a control instruction issued by the CPU 111, as required, thereby informing the user of required information. For instance, in the event that an anomaly, such as a failure in the apparatus or a paper jam, has arisen, a message for informing the user of occurrence of the anomaly is displayed. Alternatively, when the amount of toner remaining in any of the developing sections has decreased to a predetermined level or less; e.g., a near-end level to be described later, a message for announcing the approach of a time for replacement of the developing sections is displayed.

A display device; e.g., a liquid-crystal display or the like, can be used as the display 12. In place of the display device, a warning lamp which is illuminated or caused to blink may also be employed when necessary. Moreover, a warning device, which issues sound, such as a previously-recorded voice message or beep sound, other than visual information of a message to the user through display of the message may be employed, or the warning lamp and the warning device may be used in combination, if necessary.

The controller 11 is provided with image memory 113 for storing an image output from an external apparatus such as a host computer, by way of the interface 112. Reference numeral 106 designates a ROM for storing a calculating program to be executed by the CPU 101 and control data to be used for controlling the engine section EG. Reference numeral 107 designates a RAM for temporarily storing results of calculating operation performed by the CPU 101 and other data. As mentioned previously, a nonvolatile FRAM may be employed for the RAM 107.

There will now be describe the manner of determining the amount of remaining toner in the respective developing sections (i.e., toner cartridges) 4Y, 4M, 4C, and 4K in the image forming apparatus having the foregoing configuration. In relation to the image forming apparatus of this type there has already been developed a single image forming apparatus which enables replacement and loading of toner cartridges having two different volumes; that is, a toner cartridge accommodating a large amount of toner and another cartridge accommodating a small amount of toner. In such a case, the life of the toner cartridge varies according to the amount of toner accommodated in the large toner cartridge or the amount of toner accommodated in the small toner cartridge.

Figure 4:
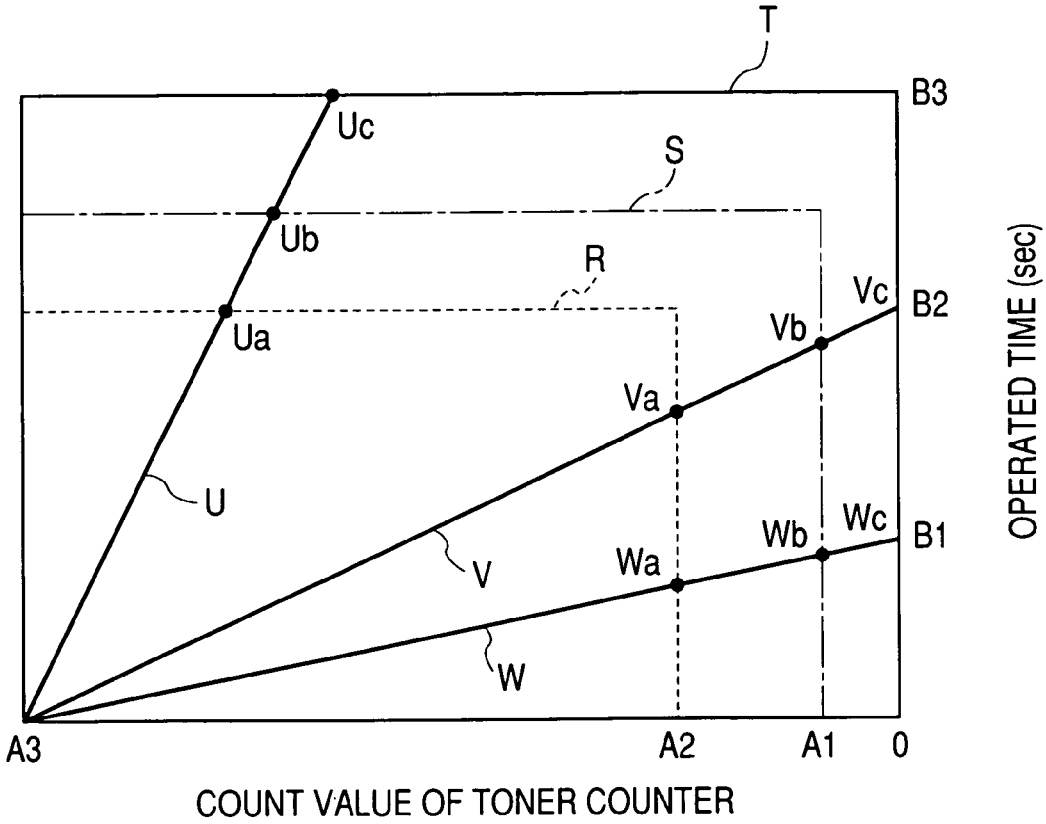
FIGS. 4 and 5 are graphs for explaining how to manage a life of a toner cartridge.

In FIG. 4, a count of the toner counter is set on the horizontal axis, and an operated time of the development roller (a cumulative time [sec]) is set on the vertical axis. In connection with the count of the toner counter, a maximum of 130,000,000 is set as an example count in the case of a large toner cartridge which enables formation of images on 6000 sheets of A4-size paper.

Moreover, in the case of a small toner cartridge which is to be loaded in the same image forming apparatus and enables formation of images on 2000 sheets of A4-sized paper, the count of the toner counter is set to a maximum of 5,000,000. According to the present invention, regardless of the toner cartridge used, the large toner cartridge or the small toner cartridge, the life of the toner cartridge can be managed appropriately.

In the case of the large toner cartridge, the operated time of the development roller set on the vertical axis is set to a maximum of, e.g., 12,000 sec. Moreover, in the case of the small toner cartridge, the operated time of the development roller is set to a maximum time of, e.g., 4,000 sec. The life of the toner cartridge is determined on the basis of whether or not any of parameters; that is, whether or not the count of the toner counter set on the horizontal axis and the operated time of the development roller set on the vertical axis, has reached a preset value. Specifically, the life of the toner cartridge is determined on the basis of a logical OR value in relation to which of the count of the toner counter and the operated time of the development roller has reached the preset value.

In the embodiment shown in FIG. 4, three levels are set according to the amount of remaining toner at the time of determination of the life of such a toner cartridge. Specifically, the levels are set in decreasing sequence of the amount of remaining toner; that is, (1) a near-end level, (2) an end level, and (3) an end-end level, from the largest amount to smaller amounts. When the amount of remaining toner has decreased from the initial value and reached the (1) near-end level, a warning message "Only a small amount of toner remains" or "The toner cartridge must be replaced soon" is displayed on the display 12.

When the amount of remaining toner has further decreased from (1) near-end level and reached (2) end level, an operation call "Please replace the toner cartridge" is displayed on the display 12. The image forming apparatus may be imparted with the function of displaying the operation call every time an image is formed on one sheet, to thus hinder consecutive formation of images.

When the amount of remaining toner has reached (3) end-end level as a result of a further decrease in the amount of remaining toner, control operation is performed such that no image can be formed on the sheet. Therefore, the user can ascertain the time for replacement of a toner cartridge stepwise, and hence superior convenience is achieved, whereby the user's convenience can be enhanced.

In FIG. 4, a dashed line R designates a near-end level; a chain line S designates an end level; and a solid line T designates an end—end level. The count of the toner counter set on the horizontal axis is set to the maximum value A3, the near-end value A2, and the end value A1. Further, the operated time of the development roller set on the vertical axis is set to the maximum (end—end) level B3, the end level B2, and the near-end level B1.

The count of the toner counter is set by the number of pieces (sheets) of recording paper on which images are to be formed and the size of an image formation area on a sheet (i.e., an image occupation ratio). Specifically, the count of the toner counter varies according to the total amount of images formed on a sheet. In FIG. 4, U designates a characteristic achieved at an image occupation ratio of 1%; V designates a characteristic achieved at an image occupation ratio of 5%; and W designates a characteristic achieved at an image occupation ratio of 20%. The characteristic U is assumed to form images on four A4-sized sheets per job; and the other characteristics V, W are assumed to form images for one A4-sized sheet per job. As can be seen from FIG. 4, there is a tendency toward the higher the image occupation ratio, the higher the count of the toner counter and the smaller the amount of remaining toner.

In the embodiment, the near-end value A2 is achieved at 6400 (Ua) sheets in the case of the characteristic U achieved at the image occupation ratio of 1%; 4800 sheets (Va) in the case of the characteristic V achieved at the image occupation ratio of 5%; and 1200 sheets (Wa) in the case of the characteristic W achieved at the image occupation ratio of 20%. The end value A1 is achieved at 8000 (Ub) sheets in the case of the characteristic U achieved at the image occupation ratio of 1%; 6000 sheets (Vb) in the case of the characteristic V achieved at the image occupation ratio of 5%; and 1500 sheets (Wb) in the case of the characteristic W achieved at the image occupation ratio of 20%. Moreover, the end—end level is achieved at 9090 (Uc) sheets in the case of the characteristic U; 6800 sheets (Vc) in the case of the characteristic V; and 1700 sheets (Wc) in the case of the characteristic W.

As mentioned above, in the case of the characteristic U achieved at the image occupation ratio of 1% in the embodiment shown in FIG. 4, a 20% difference exists between 6400 sheets (Ua) and 8000 sheets(Ub). Further, a difference of 1090 between 8000 sheets (Ub) and the 9090 sheets (Uc) exists between the near-end A1 and the end. Moreover, in the case of the characteristic V having an image occupation ratio of 5%, a difference of 20% between 4,800 sheets (Va) and 6,000 sheets (Vb) exists between the near-end A2 and the end A1. Moreover, a difference of 800 sheets between 6000 sheets (Vb) and 6,800 sheets (Vc) is present between the end A1 and the end—end.

In relation to the operated time of the development roller set on the vertical axis, the maximum (end—end) level B3, the end level B2, and the near-end level B1 are set for each of the characteristics U, V, and W. For instance, the end—end level B3 of the characteristic U assumes a value of 12,000 sec. An appropriate near-end level and an appropriate end level are set in correspondence with the end—end level for each of the characteristics U, V, and W. In connection with determination of the life of the toner cartridge depending on the operated time of the development roller, it can be seen that the life of the toner cartridge tends to become shorter as the image occupation ratio becomes smaller.

Specifically, at a given image occupation ratio the count of the toner counter and the operated time of the development roller are contrary in characteristic to each other in terms of the life of the toner cartridge. What is meant by this is that even in the case where the image occupation rate is low, the life viewed from the operated time of the development roller is shortened though the amount of consumed toner is small because deterioration of toner packed in the toner cartridge is accelerated by the rotation of the development roller.

As mentioned previously, the life of the toner cartridge can be determined in terms of whether the count of the toner counter or the operated time of the development roller has reached a predetermined level.

Figures 5, 6:
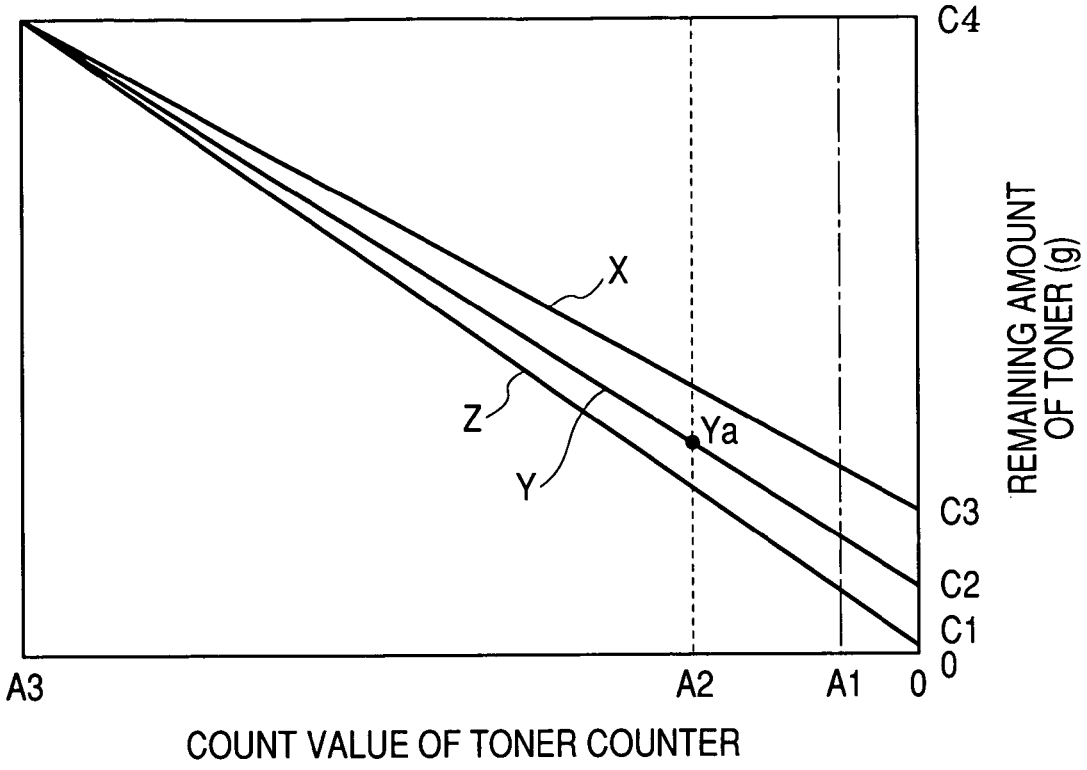
FIG. 6 shows a table for setting counted values of the toner consumption.

FIG. 5 is a characteristic drawing showing the relationship between the count of the toner counter and the amount of remaining toner. The count of the toner counter is set on the horizontal axis, and the amount of remaining toner (g) is set on the vertical axis. Even in this case, a characteristic achieved by the large cartridge changes from that achieved by the small cartridge. FIG. 5 shows the characteristic of, e.g., the large toner cartridge, which is intended for a case where an image is formed on an A4-sized sheet at an image occupation ratio of 5%.

In the embodiment shown in FIG. 5, a standard value and a numerical value which falls within ±12.5% of the standard value are set as a toner-end level. The characteristic Y designates a standard amount of remaining toner; the characteristic X designates +12.5% of the standard amount; and the characteristic Z designates −12.5% of the standard amount. In FIG. 5, an initial value C4 of the amount of toner is set to, e.g., 225 g. Moreover, the standard end value C2 of the amount of remaining toner is set to 54 g; an end value C3 achieved by the characteristic X is set to 79 g; and an end value C1 achieved at the characteristic Z is set to 30 g.

The maximum value A3, the near-end value A2, and the end value A1, which are the same as those shown in FIG. 4, are set on the horizontal axis. A near-end value Ya of a standard characteristic Y assumes a value of 83 g in this embodiment. In the present invention, the count of the toner counter used at the time of determination of the amount of remaining toner at a near-end position is set in conformity with realities of formation of images in respective colors.

FIG. 6 is an explanatory view showing an example of a table of toner counter count values for defining the near-end value of the remaining amount of toner. For example, this table is stored in the FRAM 107 shown in FIG. 9. In FIG. 6, the "type" represents the capacity of each toner cartridge. For example, Pa shows the large-capacity toner cartridge, and Pb shows the small-capacity toner cartridge. The near-end value of the remaining amount of toner is set as "count value" for each "color", that is, yellow (Y), cyan (C), magenta (M) and black (K).

In the example shown in FIG. 6, the near-end values of the remaining amount of toner for colors Y, C and M in the toner cartridge Pa are set to be a1 equally while the near-end value of the remaining amount of toner for K is a2. The near-end values of the remaining amount of toner for colors Y, C and M in the toner cartridge Pb are set to be a3 equally. Incidentally, a2 is set as a numerical value smaller than a1, and a3 is set as a numerical value smaller than a2.

In this embodiment, the near-end value of the remaining amount of toner is determined in consideration of characteristic of each color, when the image formation is performed with respect to the recording medium. Specifically, the characteristic includes the size of a print region, the amount (offset) of toner deposited on a non-image region, and so on.

In consideration of the aforementioned characteristic, the amount of consumed toner for black (K) becomes larger when image formation is performed on a predetermined number of sheets. Accordingly, the remaining amounts of toner for the respective colors are not equal. Therefore, in the example shown in FIG. 6, the near-end value of the remaining amount of toner for black (K) is set to be a numerical value smaller than those for the other colors, that is, the life count value for black (K) is set to be larger than those for the other colors to meet the actual situation of the amount of consumed toner.

Accordingly, accurate toner cartridge life management can be performed in conformity with the actual situation of toner consumption.

Figure 1A:
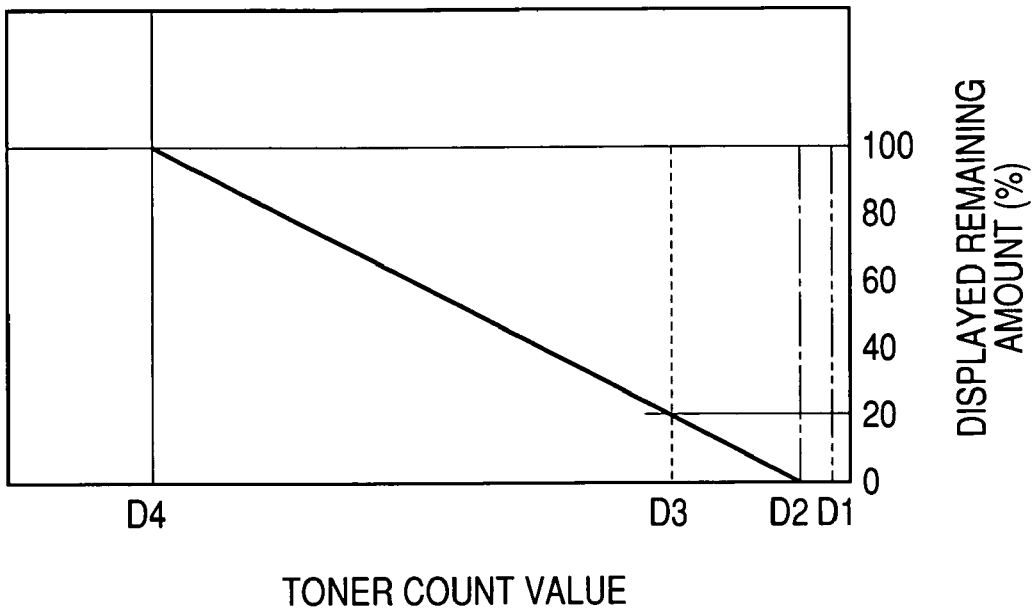
FIG. 1A is a graph for explaining how to manage a residual amount of toner in a large-capacity toner cartridge in an image forming apparatus of the invention.
Figure 1B:
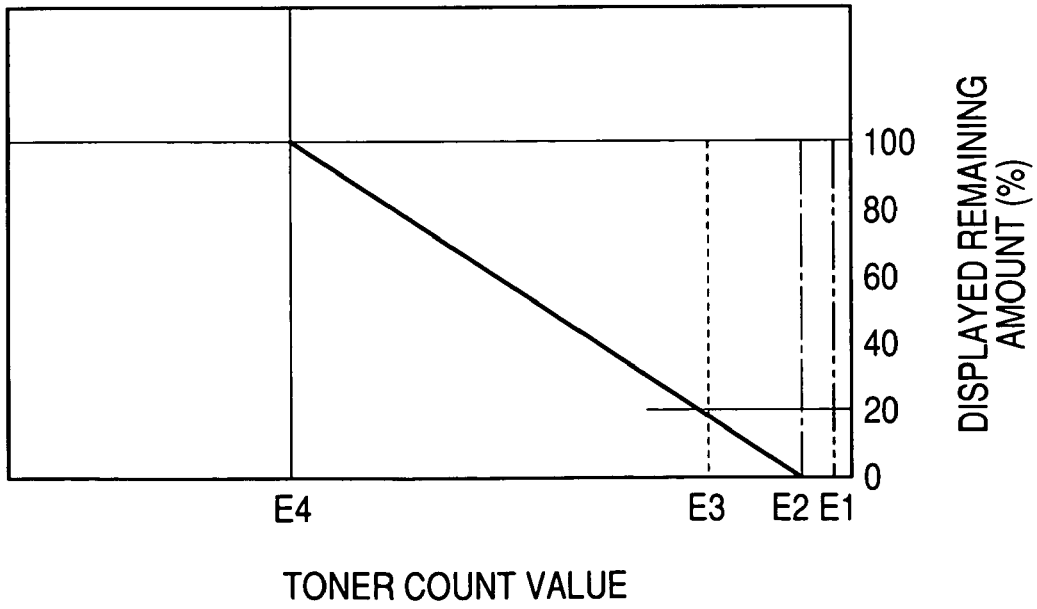
FIG. 1B is a graph for explaining how to manage a residual amount of toner in a small-capacity toner cartridge in the image forming apparatus.

Next, there will be described how to manage the remaining amount of toner in the toner cartridge with reference to FIGS. 1A and 1B. FIG. 1A shows a case for the large-capacity cartridge, and FIG. 1B shows a case for the small-capacity cartridge. In these figures, the horizontal axis expresses toner count value, and the vertical axis expresses the displayed remaining amount (%) of the toner.

In FIG. 1A, D4 is the maximum value (initial value) of the toner count value. The displayed remaining amount of toner in this case is 100%. D3 is the near-end value of the toner count value. D2 is the end value of the toner count value. D1 is the end—end value of the toner count value. In the example shown in FIG. 1A, the near-end value D3 corresponds to 20% in terms of the displayed remaining amount of toner. That is, in this embodiment, the displayed remaining amount of toner in accordance with the consumption of toner is expressed not in absolute value (analog number) but in the rate (%) relative to the initial value (100%).

In FIG. 1B, E4 is the initial value of the toner count value, E3 is the near-end value of the toner count value, E2 is the end value of the toner count value, and E1 is the end—end value of the toner count value. Also in this case, the near-end value E3 of the toner count value is set at 20% in terms of the displayed remaining amount of toner. That is, in this embodiment, the divisions of a scale for displaying the remaining amount of toner are used in common to the case where the large-capacity toner cartridge is used and the case where the small-capacity toner cartridge is used.

For this reason, it is possible to simplify the configuration of a toner remaining amount display mechanism in the image forming apparatus using toner cartridges different in capacity of toner. Moreover, arithmetic processing can be performed easily because it is unnecessary to perform separate arithmetic operations for displaying the remaining amounts of toner according to the toner cartridges different in capacity of toner. Moreover, user's convenience is improved because there is no possibility that the user will misread the remaining amounts of toner when the toner cartridges different in capacity of toner are used.

Incidentally, as will be described later, when the toner cartridges different in capacity of toner are used, the remaining amounts of toner are displayed in use of the divisions of the same scale while the near-end values in the toner cartridges are displayed at the same rate and the end values of the remaining amount of toner in the toner cartridges are displayed at the same numerical value. For this reason, it is unnecessary to change the arithmetic processing whenever a toner cartridge different in capacity of toner is used. Accordingly, internal processing can be performed quickly.

Figure 2A:
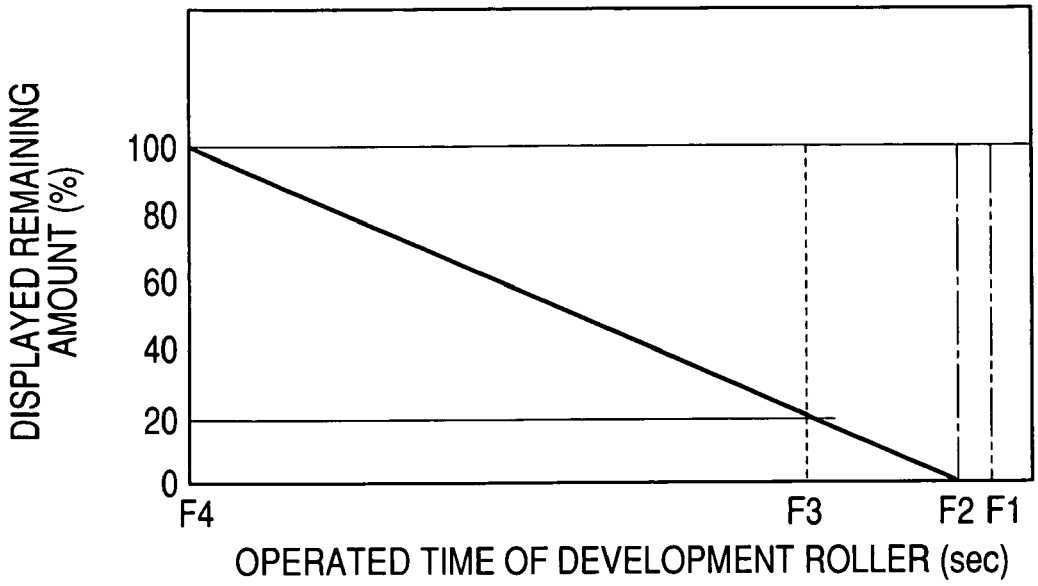
FIG. 2A is a graph for explaining an alternative way to manage a residual amount of toner in a large-capacity toner cartridge in the image forming apparatus.
Figure 2B:
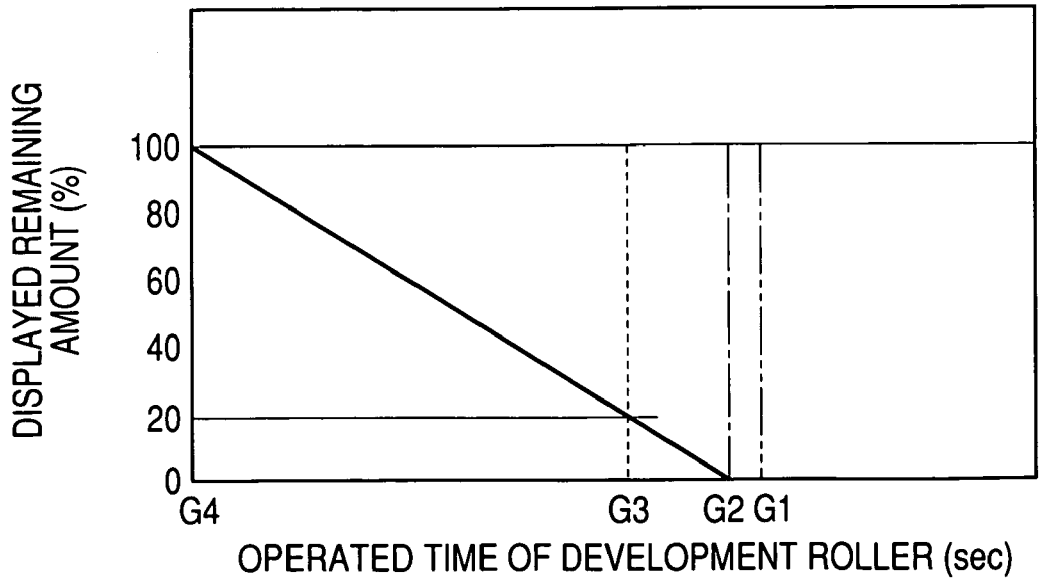
FIG. 2B is a graph for explaining an alternative way to manage a residual amount of toner in a small-capacity toner cartridge in the image forming apparatus.

FIGS. 2A and 2B shows an alternative way to manage the remaining amount of toner in the toner cartridge. FIG. 2A shows a case for the large-capacity cartridge, and FIG. 2B shows a case for the small-capacity cartridge. In these figures, the horizontal axis expresses the accumulated operation time of the development roller (sec), and the vertical axis expresses the displayed remaining amount (%) of the toner (the operable time of the development roller).

In FIG. 2A, F4 is the initial value (0) of the operated time of the development roller, F3 is the near-end value thereof, F2 is the end value thereof, and F1 is the end—end value thereof. Also in the case shown in FIG. 2A, the near-end value F3 corresponds to 20 (%) in terms of the displayed remaining amount of the toner (the operable time of the development roller).

In FIG. 2B, G4 is the initial value (0) of the operated time of the development roller, G3 is the near-end value thereof, G2 is the end value thereof, and G1 is the end—end value thereof. Also in the example shown in FIG. 2B, the near-end value G3 is set at 20 (%) in terms of the displayed remaining amount of toner (the operable time of the development roller). Accordingly, even in the case where the operated time of the development roller is used as a parameter for displaying the remaining amount of toner (the operable time of the development roller), the remaining amounts can be displayed by using the divisions of the same scale when toner cartridges different in capacity of toner are used.

That is, in this embodiment, the near-end value of the remaining amount of toner (the operable time of the development roller) is displayed as the same rate of 20% even in the case where either of the toner count value and the operated time of the development roller is used as a parameter. For this reason, user's confusion caused by change in the rate of the displayed remaining amount of toner (the operable time of the development roller) in accordance with the near-end value can be avoided even in the case where the parameter is changed.

Figure 3:
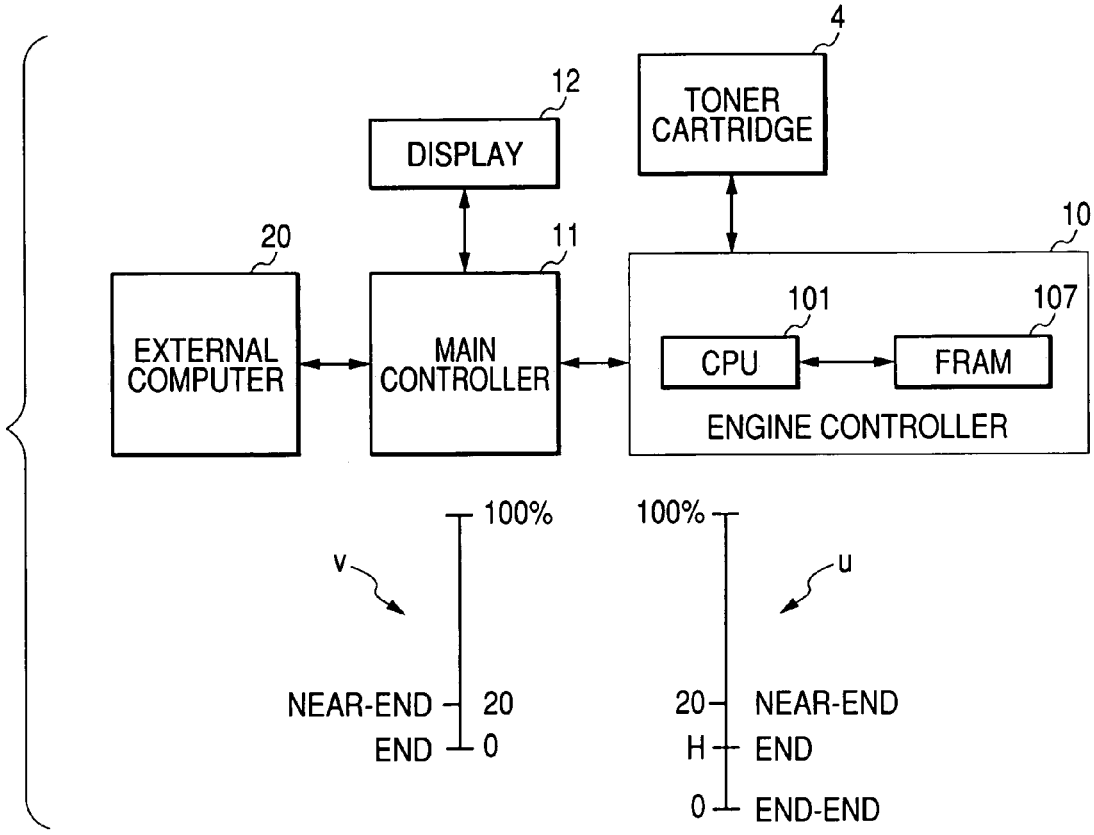
FIG. 3 is a diagram showing an essential part of the image forming apparatus.

As shown in FIG. 3, an external computer (host computer) 20 sends image data to the main controller 11. The display 12 is connected to the main controller 11 and provided for displaying various kinds of messages and the remaining amount of toner as a rate (%) relative to the initial value described above with reference to FIGS. 1A through 2B.

The CPU 101 and the FRAM 107 are provided in the engine controller 10. Each of the toner cartridges 4 is provided with a memory device (91 to 94 in FIG. 9) regardless of whether the toner cartridge 4 is of a large-capacity type or of a small-capacity type. The initial values of the toner counter count value and the operated time of the development roller and current values of the remaining amount of toner and the remaining operable time of the development roller are stored in each memory device.

After a large-capacity cartridge used for performing image formation on a recording medium is interchanged with a small-capacity cartridge for performing image formation by use of the small-capacity cartridge, the small-capacity cartridge may be interchanged with the large-capacity cartridge again by the user for performing image formation again by use of the large-capacity cartridge. Even in this case, the values of the remaining amount of toner corresponding to the large-capacity cartridge before the interchange of the large-capacity cartridge with the small-capacity cartridge have been already stored in the memory devices. Accordingly, even in the case where a toner cartridge is exchanged with another toner cartridge different in capacity before the life end of the toner cartridge, the remaining amount of toner in each of the toner cartridges can be recognized accurately. Accordingly, the life of each toner cartridge can be managed accurately.

Incidentally, when, for example, the initial value of the toner counter count value of the large-capacity toner cartridge is 130,000,000, the value of 130,000,000 is not directly stored in each memory in the toner cartridge. For example, a numerical value 150 obtained by suitably rounding a result (208) of calculation in which the value of 130,000,000 is divided by $2^{16}$ is set as the initial value of the toner counter count value for the sake of saving memory resources.

As will be described later in detail, the CPU 101 of the engine controller 10 calculates the amount of consumed toner and subtracts the amount of consumed toner from the initial value to thereby update information concerning the current remaining amount of toner. Alternatively, the CPU 101 adds the accumulated operation time of the development roller to the initial value to thereby update information concerning the current remaining amount of the operable time of the development roller. The updated information concerning the remaining amount of toner or the operable time of the development roller is stored not only in the FRAM 107 but also in each memory device in the toner cartridge 4. The process of updating the remaining amount information is performed in accordance with every color, so that the latest information concerning the remaining amount of the toner or the operable time of the development roller is always stored in the FRAM 107 and each memory device in the toner cartridge 4.

As described above with reference to FIG. 9, the CPU 111 is provided in the main controller 11. A dot counter and an image processor are provided in the CPU 111. As will be described later with reference to FIG. 10, each toner counter for counting the amount of consumed toner is formed as a software or hardware in the CPU 101 of the engine controller 10.

When image data given from the external computer 20 is input into the image processor of the main controller 11, the image processor generates an exposure signal and inputs the exposure signal into the dot counter. The dot counter counts the number of pixels by color by page on the basis of the exposure signal and sends the count value to the CPU 101. The CPU 101 of the engine controller 10 reads the initial value and coefficient of the amount of toner packed in the toner cartridge from the FRAM 107 for every color.

For example, the coefficient is a weighting coefficient used for image formation. The coefficient will be described later in detail. The CPU 101 calculates a result of an arithmetic operation in which the count value is weighted by the coefficient, that is, the CPU 101 calculates the amount of consumed toner. In this manner, the CPU 101 of the engine controller 10 calculates the dot count value, that is, the toner counter count value (the amount of consumed toner) on the basis of the count value received from the dot counter for every color and every page and the coefficient read from the FRAM 107.

The CPU 101 calculates a new remaining amount of toner by subtracting the amount of consumed toner from the old remaining amount of toner and stores the result in the FRAM 107. The information concerning the remaining amount of toner is also sent to the main controller 11. Though not shown, a signal of a timer concerning the operated time of the development roller is input into the CPU 101 of the engine controller 10 when the development roller is operating. The operated time is accumulated in accordance with every job, so that the accumulated operation time is stored in the FRAM 107.

The initial value (0) of the operated time and the maximum value of the remaining operable time of the development roller are stored in the FRAM 107. The CPU 101 sends the toner cartridge drive time measured by the timer or program timer as described above to a counter 210 (FIG. 10) for counting the accumulated operation time of the development roller. An calculator 206 acquires the accumulated value of the operated time of the development roller of the toner cartridge counted by the counter 210. The accumulated value of the operated time of the development roller is sent to the CPU 101. The CPU 101 adds the accumulated value to the initial value of the operated time of the development roller read from the FRAM 107. The CPU 101 subtracts the accumulated total value from the maximum value read from the FRAM 107 to thereby calculate the remaining amount of the operable time of the development roller.

Accordingly, the operated time of the development roller is accumulated from the initial value successively, so that the accumulated value of the operated time of the development roller is stored in the FRAM 107. The CPU 101 calculates the remaining amount of the operable time of the development roller on the basis of the current accumulated operation time and judges the life of the toner cartridge from the remaining amount of the operable time of the development roller. When the drive time reaches the near-end value, a message of "The time for interchange of cartridge is approaching" is displayed on the display.

Next, a specific example of display of the remaining amount of toner (the remaining amount of the operable time of the development roller, hereinafter simply referred to as "remaining amount of operable time") will be described. The CPU 101 of the engine controller 10 calculates the remaining amount of toner or the remaining amount of operable time on the basis of the toner counter count value or the accumulated operable time of the development roller. Accordingly, the CPU 101 has information concerning the remaining amount of toner (the remaining amount of operable time) in a range of from the end—end value (0%) to the initial value (100%). As described above with reference to FIGS. 1A through 2B, the near-end value is set, for example, as the rate of 20%.

As shown in FIG. 3, an end value H is set between the near-end value and the end—end value. The engine controller 10 sends information concerning the remaining amount of toner (the remaining amount of operable time) to the main controller 11. The remaining amount of toner (the remaining amount of operable time) is displayed on the display 12 on the basis of the information. On this occasion, the remaining amount of toner (the remaining amount of operable time) displayed on the display is expressed as the rate (%) relative to the initial value 100% in the condition that the end value corresponds to 0%.

That is, information (v) of the remaining amount of toner (the remaining amount of operable time) in the engine controller 10 is provided so that the end—end value is set at 0% with respect to the initial value. On the other hand, information (u) of the remaining amount of toner (the remaining amount of operable time) in the main controller 11 is provided so that the end value is set at 0%. Although a message of "Interchange the toner cartridge" is displayed on the display when the remaining amount of toner (the remaining amount of operable time) reaches the end value, the message does not change even in the case where the remaining amount of toner (the remaining amount of operable time) reaches the end—end value. Incidentally, in each information (u) or (v), only an example of display of the remaining amount of toner is shown for the sake of simplification.

If the user is notified of the fact that the remaining amount of toner (the remaining amount of operable time) reaches the end value, the user can understand that the toner cartridge must be interchanged with a another one. Accordingly, it can be said that this display meets the actual situation because it is particularly unnecessary to display the end—end value smaller in the remaining amount of toner (the remaining amount of operable time) than the end value.

The display of the end value of the remaining amount of toner (the remaining amount of operable time) will be described further specifically. The remaining amount of toner (the remaining amount of operable time) is displayed on the display 12 by the divisions of the same scale regardless of the toner capacity of the toner cartridge while the near-end value of the remaining amount of toner (the remaining amount of operable time) is displayed, for example, at the same rate of 20%. In this manner, the remaining amount of toner (the remaining amount of operable time) is displayed at the same rate regardless of the toner capacity (the maximum value of the operable time of the development roller) of the toner cartridge in the period of from the point of time when the toner cartridge is attached newly to the point of time when the remaining amount of toner (the remaining amount of operable time) reaches the near-end value. Accordingly, the user can recognize the remaining amount of toner (the remaining amount of operable time) without confusion.

The end value is displayed as the rate of 0% on the assumption that the maximum value of the toner capacity or development roller drive time is regarded as 100%. In the engine controller, the end—end value is however set as the rate of 0% in the aforementioned manner. Accordingly, the end value H between the near-end value and the end—end value is formed so that the rate of the end value H managed by the engine controller 10 has a certain value (e.g. 10%) with respect to the maximum value.

In this embodiment, the end value of the remaining amount of toner (the remaining amount of operable time) is sent to the main controller 11 so that the end value is expressed as a numerical value common to the plurality of toner cartridges. That is, the end value H is set as a significant numerical value regardless of the capacity of the toner cartridge, and the end value H is sent to the main controller 11 when the engine controller 10 judges the end value H. For example, the end value H of the remaining amount of toner is set as a numerical value of about 500,000 which is about 10% as large as the initial value 5,000,000 in the small-capacity toner cartridge.

In this manner, the near-end value of the remaining amount of toner (the remaining amount of operable time) is displayed at the rate common to the plurality of toner cartridges. Accordingly, the user can recognize the remaining amount of toner without confusion. Moreover, the end value of the remaining amount of toner (the remaining amount of operable time of the development roller) is displayed as a numerical value common to the plurality of toner cartridges. Accordingly, the user can recognize the toner cartridge's arrival at the end value clearly regardless of the toner capacity of the toner cartridge. For this reason, it is possible to prevent image deterioration such as image caused by shortage of the remaining amount of toner (the operable time of the development roller) in continuous image formation.

In FIG. 3, when the remaining amount of toner (the remaining amount of operable time) is newly stored in the FRAM 107 in the aforementioned manner, the CPU 101 compares the updated remaining amount of toner (the updated remaining amount of operable time) with the near-end value. When the remaining amount of toner (the remaining amount of operable time) reaches the near-end value, the CPU 101 outputs a signal for notifying the user of the fact that the life of the toner cartridge is running out.

Incidentally, there may be configured such that the rate of the remaining amount of toner and the rate of the remaining amount of the operable time of the development roller are compared with each other, and that a lower one is selected by the CPU 101 and displayed. In this case, the user can recognize the shortage of the life of the toner cartridge more clearly because smaller one of the rate of the remaining amount of toner and the rate of the remaining amount of the operable time of the development roller is displayed. The user can make preparation for interchange of the toner cartridge. In addition, internal processing for displaying the remaining amount can be performed easily compared with the case where both the remaining amounts are displayed because only smaller one in terms of the rate of the remaining amount is displayed.

FIG. 7 is a flow chart showing a process of judging the life of the toner cartridge on the basis of the remaining amount of toner or the remaining amount of the operable time of the development roller is performed. The life is managed in accordance with every capacity of the toner cartridge and every color. When the apparatus is activated (step S1), the state of the remaining amount of toner is judged (step S2). When the judgment in step S2 results in the end—end state, the state is transited to the end—end state (step S3). The term "transition of state" means transition from a certain state to another certain state.

When the judgment in step S2 results in the near-end state, the state is transited to the near-end state (step S4). When the judgment in step S2 results in a normal state in which toner more than the near-end level is remaining in the toner cartridge, the state is transited to the normal state (step S5). In the normal state, generation of a signal for displaying a message of "The time interchange of the toner cartridge is approaching" is inhibited in the case where a toner near-end (warning) signal is generated by a malfunction. Further, generation of a signal as an operation call for urging the user to interchange the toner cartridge in the toner end state is also inhibited.

Incidentally, in the normal state, the amount of consumed toner and the operated time of the development roller are counted and stored in the FRAM 107. When the state is transited from the normal state to the near-end state, an operation for the near-end state is performed. The transition of state in this case is expressed by the bold arrow so as to be distinguished from the transition of state at the time of apparatus activation. In the operation for the near-end state, a message of "The time for interchange of the toner cartridge is approaching" is displayed but notification of an operation call for urging the user to interchange the toner cartridge is inhibited.

In the near-end state, the amount of consumed toner and the operated time of the development roller are counted and stored in the FRAM 107. When the state is transited from the near-end state to the end—end state, an operation for the toner end—end state is performed. In this case, generation of a message signal based on the toner near-end state stops and generation of a signal for the interchange of the toner cartridge is performed. In this manner, in FIG. 7, when the remaining amount of toner in the toner cartridge is in the normal state, the near-end state or the end—end state, a flag is set for indicating each state. Accordingly, only generation of a signal corresponding to the flagged state is validated. Processing is made so that instructions valid in the other states are not accepted.

In the case where the toner cartridge is interchanged with a another one in each of the normal state, the near-end state and the end—end state, a life expectancy value obtained by subtracting the remaining amount of toner from the initial value of the toner cartridge is reset and necessary processing such as updating the initial value is performed with the interchange of the toner cartridge. Then, the life judgment of the toner cartridge in S1 is performed.

There will now be described the configuration and operation of the toner counter with reference to FIG. 10.

In this device, the CPU 101 performs predetermined processing operation on the basis of the program stored in the ROM 106 shown in FIG. 9, thereby determining the amount of toner consumed by the image formation area. Specifically, all the configuration of the toner counter is implemented by software but may also be implemented by hardware.

Figure 10:
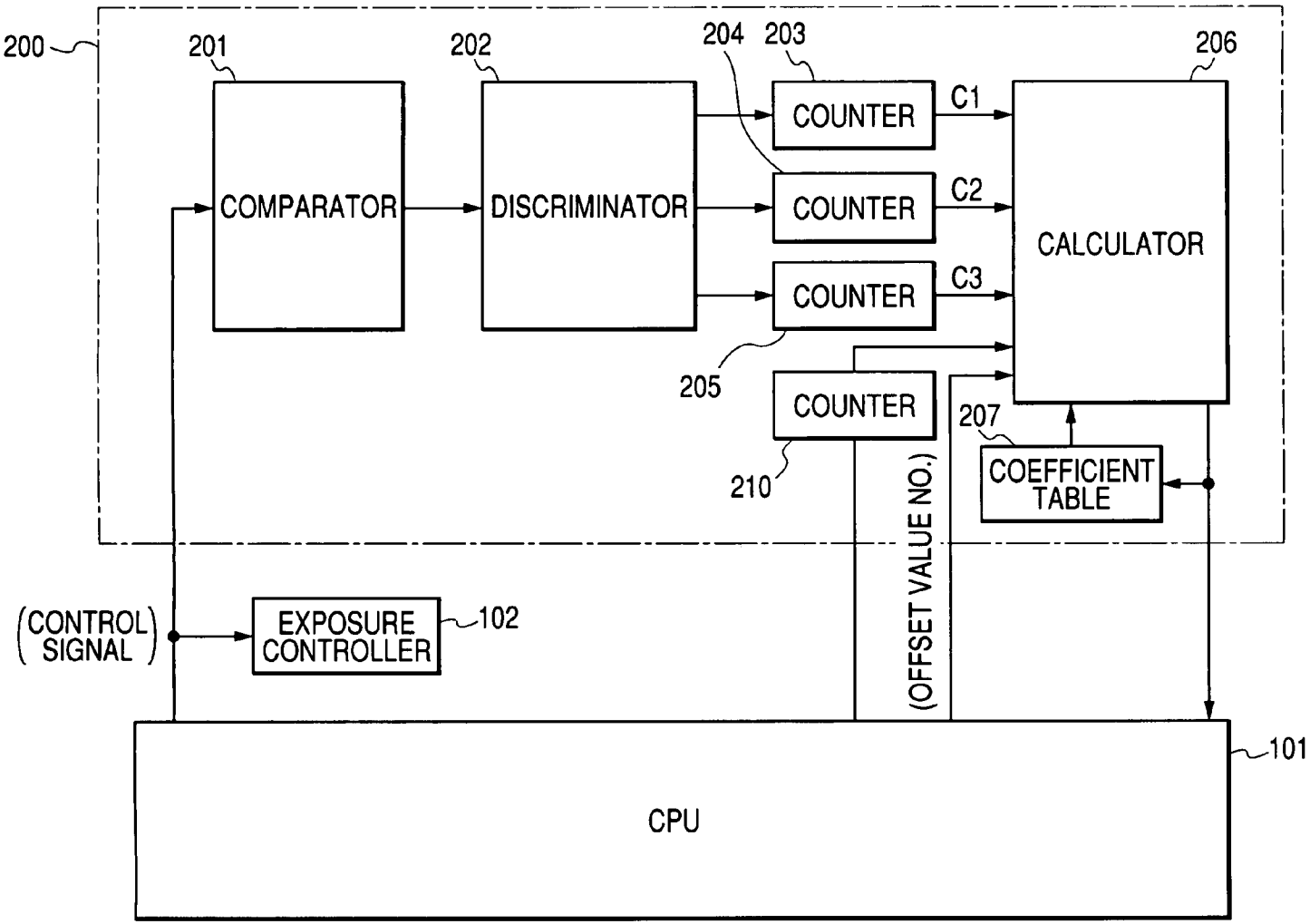
FIG. 10 is a block diagram showing a toner counter in the image forming apparatus of FIG. 8.

Here, the principle of operation of the toner counter according to the invention will be described while a toner counter 200 having the hardware configuration shown in FIG. 10 is taken as an example. Even when the circuit shown in FIG. 10 is implemented by software, the amount of toner consumption can be determined on the basis of the same principle as that employed in the case of the hardware.

On the basis of a control signal identical with that delivered from the CPU 101 to the exposure controller 102; that is, an image signal input from the external apparatus, a signal converted into a gradation value for each color of toner is input to the toner counter 200. On the basis of the control signal, the comparator 201 permits passage of a signal corresponding to a print dot whose gradation value is equal to or larger than a predetermined threshold value, and the signal is input to a discriminator 202. The discriminator 202 determines the arrangement of print dots on the basis of the signal output from the comparator 201.

Specifically, the discriminator 202 detects the number of dots constituting the train of print dots, classifies the dots into three categories; that is, a pattern of dots which are larger than a threshold value; a pattern of four continuous dots; and a pattern of isolated dots, and outputs "1" to any of counters 203 to 205 according to the category. Here, the isolated dots are dots in which adjacent pixels on both sides of a pixel of certain threshold value or more are less than the threshold value. The counters 203, 204, and 205 are provided so as to correspond to the pattern of dots which are larger than a threshold value, the pattern of four continuous dots, and the pattern of isolated dots, respectively. The counters 203 to 205 count the number of times a train of print dots is formed into a pattern of interest, by counting a signal output from the discriminator 202 at any times.

For instance, when the control signal input to the comparator 201 corresponds to the pattern of isolated dots, the discriminator 202 determines the print dots as isolated dots in accordance with the signal output from the comparator 201. The discriminator 202 outputs "1" to the counter 205 but "0" to the other counters 203, 204. By such processing, only the count of the counter 205, which shows the number of times the pattern of isolated dots is formed is incremented by one.

However, at this time, the counts of the other counters 203, 204 remain unchanged. Similarly, when the control signal input to the comparator 201 corresponds to the pattern of four continuous dots, the count of the corresponding counter 204 is incremented by one. Thus, the number of times the print dots are formed is individually counted on a per-pattern basis.

The counts C1, C2, and C3 are input to a calculator 206. In addition to the count values C1, C2, and C3, offset values "No" for respective colors output from the CPU 101 and an output from a coefficient table 207 are input to the calculator 206. An output from the calculator 206 is input to the CPU 101 and the coefficient table 207. The coefficient table 207 stores a plurality of sets of numerals, which would be candidates for "weighting coefficients" Kx, K1, K2, and K3 (see Equation 1 provided below), beforehand, and any one is selected from the sets in accordance with an output from the calculator 206.

The calculator 206 multiplies the counts C1, C2, and C3 output from the respective counters 203 to 205 by the weighting coefficients K1, K2, and K3 selectively output from the coefficient table 207, as well as summating them. Further, the offset value No output from the CPU 101 is added to a product of the sum and the coefficient Kx. Through the foregoing calculations defined by Equation (1), the amount of toner consumption Ct (first amount of toner consumption) is determined. Here, Kx designates a color dependence coefficient which changes from color to color.

$$Ct=Kx(K1-C1+K2\cdot C2+K3\cdot C3)+\mathrm{No}$$

As mentioned previously, in the embodiment, all the functions of the toner counter 200 are implemented as software. Such a configuration obviates a necessity for adding special hardware for addition of the amount of toner consumption and renders the configuration of the image forming apparatus simple, thereby curtailing costs of the apparatus.

As has been described above, according to the present invention, in an image forming apparatus which forms an image on a recording medium in a plurality of colors of toner through use of a rotary developer, the amount of toner consumption can be calculated with high accuracy in keeping with the realities of image forming operation. Even in the image forming apparatus using the intermediate transfer member, the quantity of toner consumption can be calculated with high accuracy.

The foregoing embodiment is directed toward the image forming apparatus configured so as to be able to form a full-color image through use of four colors of toner; that is, yellow toner, cyan toner, magenta toner, and black toner. In terms of the colors of toner to be employed and the number of colors of toner to be employed, the present invention is not limited to the embodiments, and arbitrary colors of toner and numbers of colors can be employed. For instance, the present invention can also be applied to an apparatus which forms a monochrome image through use of, e.g., only black toner. Moreover, the amount of toner consumed by a plurality of developers can be determined individually by a single hardware configuration.

Further, according to the embodiments, the present invention is applied to a printer which performs image forming operation on the basis of an image signal output from an external apparatus. The present invention is not limited solely to such a printer. Needless to say, the present invention can be applied to a copier which prepares an image signal in an apparatus in response to an image forming request from the user; e.g., a user's action of pressing a copy button, and performs an image forming operation in accordance with the image signal or a facsimile apparatus which performs an image forming operation in accordance with an image signal received by way of a communications line.

Incidentally, in the above description, the remaining amount of the toner counter count value and the remaining amount of the operable time of the development roller are used as parameters for managing the life of each toner cartridge. The invention can be also applied to the case where the remaining amounts of count values in other parameters are expressed as rates to thereby manage the life of each toner cartridge. In this case, the user can judge the time for interchange of the toner cartridge more clearly when the lowest one of the remaining amounts of count values in the parameters is displayed as the rate.

What is claimed is:

1. A device for managing a life of at least one toner cartridge loaded in an apparatus for forming an image on a recording medium with toner stored in the toner cartridge, the device comprising:

a counter, which counts a remaining amount of each of a plurality of predetermined parameters;

a replacement determinant, which determines that the toner cartridge should be replaced with another one when the remaining amount of any one of the parameters is a predetermined amount or less;

a display, operable to display the remaining amount of each of the parameters as a percentage relative to a full remaining amount thereof; and a selector, which selects one of the parameters indicating the lowest remaining amount as the remaining amount displayed on the display.

2. The device as set forth in claim 1, wherein:

the toner cartridge is provided with a development roller which supplies the toner to the outside of the toner cartridge; and the parameters includes an amount of the toner remaining in the toner cartridge, and a remained operable time of the development roller.

3. The device as set forth in claim 2, wherein:

a plurality of toner cartridges having different capacities are provided for the same color; and the display is provided with a scale which is common to the parameters and the toner cartridges, so that a predetermined percentage is associated with a threshold value regarding the remaining amount for each of the parameters and the toner cartridges.

4. The device as set forth in claim 3, wherein:

a plurality of colors of toner including black toner are used to form the image; and the threshold value associated with the black toner is less than the threshold value associated with any one of the colors of toner.

5. The device as set forth in claim 3, wherein the remaining amount for one of the toner cartridges which is associated with the predetermined amount is different from the remaining amount for another one of the toner cartridges which is associated with the predetermined amount.

6. The device as set forth in claim 2, further comprising a storage, which stores an initial amount of the toner remaining in the toner cartridge as the full remaining amount, wherein the counter subtracts a consumed amount of the toner to determine the amount of toner remaining in the toner cartridge.

7. The device as set forth in claim 6, wherein the storage is provided with the toner cartridge.

8. The device as set forth in claim 2, further comprising a storage, which stores an initial amount of the operable time of the development roller as the full remaining amount, wherein the counter subtracts an operated time of the development roller to determine the remained operable time of the development roller.

9. The device as set forth in claim 8, wherein the storage is provided with the toner cartridge.

10. The device as set forth in claim 1, wherein the predetermined amount is changed in accordance with an image occupation ratio which is an area ratio of the image formed with the toner relative to the recording medium.

11. An image forming apparatus, comprising the device as set forth in claim 1, wherein the toner supplied from the toner cartridge is transferred onto an image supporting member to form a toner image for visualizing an electrostatic latent image formed on the image supporting member in advance.

12. The image forming apparatus as set forth claim 11, wherein the toner image is transferred onto an intermediate transferring member before the toner image is transferred onto the recording medium.

13. A method for managing a life of at least one toner cartridge loaded in an apparatus for forming an image on a recording medium with toner stored in the toner cartridge, the method comprising steps of:

counting a remaining amount of each of a plurality of predetermined parameters;

determining that the toner cartridge should be replaced with another one when the remaining amount of any one of the parameters is a predetermined amount or less;

selecting one of the parameters indicating the lowest remaining amount; and displaying the lowest remaining amount of the selected one of the parameters on a display as a percentage relative to a full remaining amount thereof.

14. The method as set forth in claim 13, wherein:

the toner cartridge is provided with a development roller which supplies the toner to the outside of the toner cartridge; and the parameters includes an amount of the toner remaining in the toner cartridge, and a remained operable time of the development roller.

15. The method as set forth in claim 14, wherein:

a plurality of toner cartridges having different capacities are provided for the same color; and the display is provided with a scale which is common to the parameters and the toner cartridges, so that a predetermined percentage is associated with a threshold value regarding the remaining amount for each of the parameters and the toner cartridges.

16. The method as set forth in claim 15, wherein the remaining amount for one of the toner cartridges which is associated with the predetermined amount is different from the remaining amount for another one of the toner cartridges which is associated with the predetermined amount.

* * * * *